United States Patent [19]

Specht et al.

[11] Patent Number: 4,652,771

[45] **Date of Patent: * Mar. 24, 1987**

[54] OSCILLATING FLUX TRANSFORMER

[75] Inventors: Theodore R. Specht, Sharon, Pa.; Robert M. Del Vecchio, Sunnyvale, Calif.

[73] Assignee: Westinghouse Electric Corp., Pittsburgh, Pa.

[ * ] Notice: The portion of the term of this patent subsequent to Jun. 17, 2003 has been disclaimed.

[21] Appl. No.: 807,146

[22] Filed: Dec. 10, 1985

[51] Int. Cl.[4] ..... H01H 85/02

[52] U.S. Cl. ..... 307/83; 307/7; 307/416; 336/229; 336/5

[58] Field of Search ..... 307/7, 83, 413, 412, 307/414, 415, 416, 417, 418, 419, 420, 421, 422; 336/220, 221, 225, 229, 206, 208, 5, 10, 12; 376/128, 140, 135, 142, 134, 146, 136, 132, 133, 130, 143; 363/154; 323/215, 250, 251, 301, 331, 332, 355, 305, 328, 329

[56] References Cited

U.S. PATENT DOCUMENTS

| | | | |
|---|---|---|---|
| 2,655,623 | 10/1953 | Parker | 336/229 X |
| 2,888,637 | 5/1959 | Lipkin | 323/329 |
| 3,004,171 | 10/1961 | Lipkin | 307/416 |
| 3,149,296 | 9/1964 | Cox | 336/229 X |
| 3,384,810 | 5/1968 | Kelsey | 323/329 |
| 3,886,402 | 5/1975 | Furth et al. | 376/136 X |
| 4,205,288 | 5/1980 | Lin et al. | 336/5 |
| 4,235,668 | 11/1980 | Bass et al. | 376/133 X |
| 4,292,124 | 9/1981 | Fisch | 376/132 |
| 4,302,284 | 11/1981 | Ohkawa | 376/133 |
| 4,548,782 | 10/1985 | Manheimer et al. | 376/130 X |
| 4,551,700 | 11/1985 | Waldemar | 336/229 X |
| 4,595,843 | 6/1986 | Del Vecchio et al. | 336/229 X |

FOREIGN PATENT DOCUMENTS 213236 6/1956 Australia .

*Primary Examiner*—William M. Shoop, Jr.
*Assistant Examiner*—Shik Luen Paul Ip
*Attorney, Agent, or Firm*—D. R. Lackey

[57] ABSTRACT

An oscillating flux transformer for transforming relatively large blocks of electrical power at power frequencies in direct accordance with the turn ratio of toroidal primary and secondary windings. The transformer includes a core-coil assembly having a poloidal winding in addition to primary and secondary toroidal windings, with the poloidal and toroidal windings being disposed on a magnetic core which is in the form of a closed loop or torus. Direct current in the poloidal winding establishes an equilibrium position of a saturation induction phasor. The AC flux produced by the toroidal primary winding combines vectorially with the DC flux to cause the induction phasor to oscillate about the equilibrium position, with an angular excursion responsive to the magnitude of the voltage applied to the toroidal primary winding.

3 Claims, 4 Drawing Figures

OSCILLATING FLUX TRANSFORMER

BACKGROUND OF THE INVENTION

1. Field of the Invention

The invention relates in general to electrical transformers, and more specifically to electrical transformers in which the vector sum of the magnetic flux produced in the magnetic core creates an oscillating induction vector.

2. Description of the Prior Art

Co-pending Application Ser. No. 607,852, filed May 7, 1984, entitled "Low Core Loss Rotating Flux Transformer", now U.S. Pat. No. 4,595,843, which is assigned to the same assignee as the present application, discloses a transformer construction in which a rotating induction vector is produced in the entire magnetic core. The magnetic core is in the form of a torus, with both toroidal and poloidal windings generating phase displaced alternating flux which is added vectorially to create a rotating induction vector. By providing sufficient exciting current to produce a saturated rotating induction vector, the magnetic domains disappear and hysteresis losses are reduced to zero. The anomalous component of the eddy current losses is also eliminated at saturation. When the magnetic core is constructed of an amorphous alloy, which is nominally about 1 mil thick, a magnetic core with unusually low core losses is produced, as the elimination of the anomalous component of the eddy current losses at saturated further reduces the already low eddy current losses of an amorphous magnetic core. Application Ser. No. 607,852, is hereby incorporated into the Specification of the present application by reference.

The rotating flux transformer of the co-pending application while having many advantages, has a disadvantage with respect to how it handles an overvoltage condition on the primary winding, as a higher than normal primary voltage does not produce much more useful flux than already present. The primary current, during an overvoltage condition will thus increase, as there is very little back induced voltage to oppose it. Thus, a higher than normal primary voltage can only be accommodated by an increased IR drop.

The rotating flux transformer is also basically a two-phase, or a three-phase transformer.

SUMMARY OF THE INVENTION

Briefly, the present invention is a new and improved oscillating flux transformer which overcomes the overvoltage disadvantages of the rotating flux transformer, while preserving its low loss advantages. Also, the oscillating flux transformer is basically a single-phase transformer. The transformer of the present invention is referred to as an oscillating flux transformer because the induction vector oscillates back and forth about an equilibrium position, instead of rotating through 360°.

The core-coil assembly of the oscillating flux transformer includes a magnetic core in the form of a closed loop or torus, and both poloidal and toroidal windings. The poloidal winding is a single winding having one or more turns to which a direct current is applied. The magnitude of the direct current is selected to create a magnetic flux in a radial direction about the core leg which is sufficient to drive the core to saturation when acting alone. This defines the equilibrium position and the maximum value of a saturation induction vector which points along the small circles of the torus which surround the poloidal winding. The toroidal winding includes both primary and secondary windings. A single-phase source of power frequency alternating potential is connected to the toroidal primary winding and a load circuit is connected to the toroidal secondary winding. The magnetic flux due to alternating current in the primary winding is orthogonal to the magnetic flux produced by the direct current in the poloidal winding, circumferentially encircling the loop window. The magnetic fluxes of the poloidal winding and of the toroidal primary winding combine vectorially to produce a saturation induction vector or phasor which oscillates back and forth from the equilibrium position, with an excursion-angle responsive to the magnitude of the primary voltage. Thus, the oscillating flux transformer inherently allows for overvoltage conditions, unlike the rotating flux transformer.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
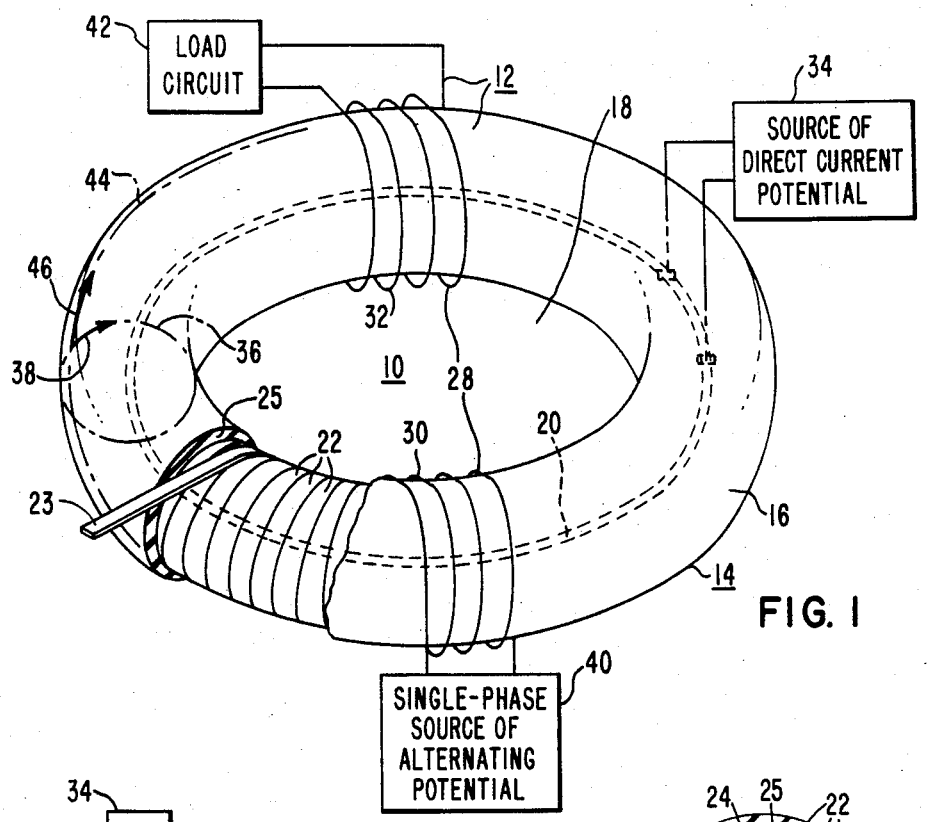
FIG. 1 is a perspective view of the core-coil assembly of an oscillating flux transformer constructed according to the teachings of the invention.
Figure 2:
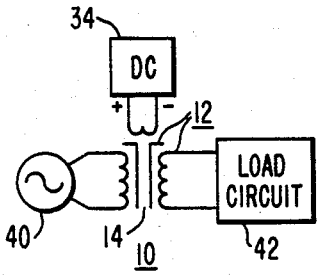
FIG. 2 is a schematic diagram of the oscillating flux transformer shown in FIG. 1.

Referring now to the drawings, and to FIGS. 1 and 2 in particular, there is shown an oscillating flux transformer 10 constructed according to the teachings of the invention. FIGS. 1 and 2 are partially diagrammatic and partially schematic diagrams of transformer 10.

Figure 3:
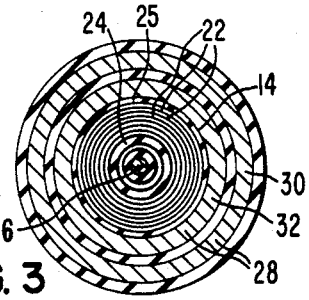
FIG. 3 is a sectional view which illustrates how the core-coil assembly of the transformer shown in FIG. 1 may be constructed.

Transformer 10 includes a core-coil assembly 12 having a magnetic core 14. Magnetic core 14 is in the form of a continuous closed loop or torus having an outer surface 16, an opening or loop window 18, and an axially extending opening or cavity 20. Magnetic core 14 is preferably constructed of a magnetic material which has a relatively high resistivity and low coercivity $H_c$ in order to produce a transformer having the lowest possible core loss. An amorphous alloy, such as Allied Corporation's 2605S-2, is preferred, but other magnetically soft electrical steels having a low coercivity may be used. FIG. 3 is a cross-sectional view taken through the winding leg of the core loop illustrating an arrangement which may be used for constructing transformer 10. Magnetic core 14 includes a plurality of concentric, tightly nested, metallic lamination turns 22, such as may be provided by spirally winding a metallic magnetic strip 23 about an insulative winding tube 24 which defines the cavity 20. In other words, a continuous magnetic strip 23 may be tape wound about tube 24, with each resulting lamination turn 22 being offset from the prior turn to advance the core construction about the loop until the desired core build dimension has been achieved. A strip of amorphous metal about 4 inches wide, for example, having a nominal thickness of about 1 mil, would be excellent for forming magnetic core 14. A layer 25 of ground insulation may be disposed about the outermost lamination turns.

Core-coil assembly 12 of transformer 10 also includes a single poloidal winding 26 having one or more turns disposed within opening or cavity 20 of magnetic core 14, and toroidal windings 28 disposed about the outer surface 16 of magnetic core 14. The toroidal windings 28 include a primary winding 30 and a secondary winding 32. Toroidal primary and secondary windings 30 and 32 are illustrated as being spaced apart on magnetic core 14 in FIG. 1, in order to simplify the drawing. In actual practice they would be concentrically disposed, as illustrated in FIG. 3, or interleaved.

Figure 4:
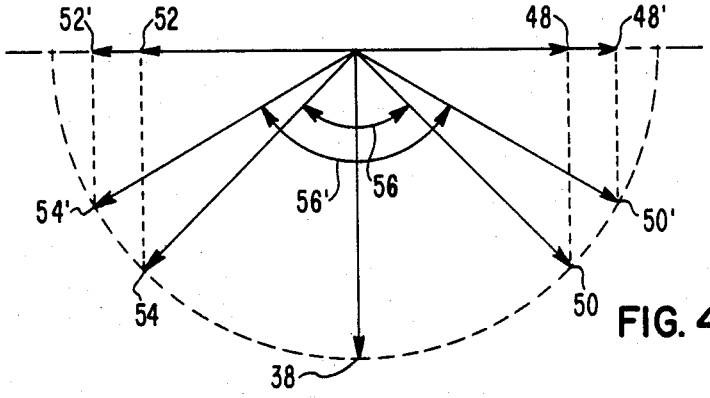
FIG. 4 is a phasor diagram illustrating how the excursion angle of the induction vector is responsive to the magnitude of the alternating potential applied to the toroidal primary winding.

A source 34 of direct current is connected to the poloidal winding 26. The direct current provided by source 34 should be of sufficient magnitude to drive magnetic core 14 to saturation by itself, i.e., without regard to the magnetic flux provided by the toroidal windings 28. Unlike control applications of orthogonal flux devices, source 34 need not be adjustable, because the direct current has no control function in the present transformer. The sole purpose of the direct current is to saturate magnetic core 14 and define the equilibrium position of the saturation induction vector. The magnetic flux created by the poloidal winding 26 follows the small circles of magnetic core 14, e.g., the circle 36 in FIG. 1, and the resulting induction B is represented by phasor 38 in FIGS. 1 and 4. FIG. 4 is a phasor diagram which illustrates the equilibrium position and the saturation magnitude defined by the saturation vector or phasor 38.

A single-phase source 40 of alternating potential having a power frequency, such as 60 Hz, is connected to the toroidal primary winding 30. Source 40 may be a voltage source in a distribution system of an electrical utility, for example. A load circuit 42 is connected to the secondary winding 32. The magnetic flux in magnetic core 14 which is responsive to the alternating current flowing in the toroidal primary winding 30 is circumferential, following the large circles of the torus, i.e., around the loop opening 18, as represented by broken line 44. The resulting induction B is represented by arrow 46 in FIG. 1.

FIG. 4 illustrates how the saturation induction vector resulting from the DC and AC magnetic fluxes oscillates back and forth about the equilibrium position established by phasor 38. Ideally, the magnitude of the oscillating saturation induction vector is constant, in order to provide minimum losses. In other words, it should not fall below the saturated or maximum value indicated by phasor 38 in FIG. 4. As the AC flux changes from zero, the magnitude of the DC flux is automatically reduced and it has an AC component. Eddy currents flow at right angles to the flux. Thus, it is critically important to the practicability of the oscillating flux transformer that the magnetic core 14 is constructed such that no flux ever enters a major surface or side of a core lamination perpendicular thereto, regardless of which flux path is being considered, as prohibitively large eddy current losses would result. Thus, butt joints between an edge and a face of a lamination are to be avoided. Another reason for the specified core construction is the fact that in order to keep excitation currents low and achieve minimal losses, the reluctances of the radial and circumferential flux paths should be low. Both flux paths must be within, and remain within the plane of the magnetic strip 23, either flowing with the strip direction, or across the strip width, and never in a direction between the major opposed surfaces or sides of the strip. Butt joints and air gaps in the radial and circumferential directions are also to be avoided because of their adverse effect on exciting current and losses. For example, since the AC winding 30 must carry current in order to force the induction vector to turn, if the magnetic path for flux produced by the poloidal winding has air gaps, the DC poloidal current must be higher to produce the same amount of flux than for a lower reluctance path. As the saturated induction vector swings from the equilibrium position defined by phasor 38, the DC flux is reduced and its AC component increases. Thus, as the induction vector swings, a higher than desired DC excitation current results in a larger AC excitation current, leading to increased no-load losses in both the poloidal and primary toroidal windings.

When the AC flux is zero, the induction phasor is responsive to the DC flux, represented by phasor 38. When the AC flux responsive to a normal primary voltage magnitude increases from zero and reaches the positive peak 48, the vector combination of DC and AC fluxes produces an induction phasor which swings from the position of phasor 38 to the position of phasor 50. When the AC flux responsive to a normal primary voltage magnitude reduces from the positive peak 48 and reaches the negative peak 52, the vector combination of DC and AC fluxes produces an induction phasor which swings from the position of phasor 50 to the positions of phasor 54. Thus, for a normal primary voltage magnitude, the induction phasor oscillates about the equilibrium position 38, with a total angular swing or excursion indicated at 56.

If the primary voltage should increase from the normal magnitude, i.e., an overvoltage condition occurs, the resulting positive and negative flux peaks increase to 48' and 52', respectively. The resulting positive and negative limits of the angular excursion of the induction phasor increase to 50' and 54', respectively, and the total angular excursion increases to 56'. Thus, overvoltage conditions are automatically accommodated.

It is important to note that the present invention is distinguishable from orthogonal flux control devices in the use of a closed loop magnetic core whose magnetic reluctance is as low as possible in the directions of both the AC and DC magnetic fluxes; in the use of magnetically soft electrical steels, preferably amorphous alloys, having a low coercivity $H_c$; in the use of a direct current whose magnitude is not controlled during normal use of the transformer; and, in the fact that the input and output voltages are directly related by the turns ratio of the primary and secondary windings. In other words, the transformer of the present invention is a power transformer suitable for use in transforming large amounts of power frequency power, such as required by a distribution transformer in an electrical power distribution system. The transformer of the present invention is not a variable inductor, or a small signal control device.

In summary, there has been disclosed a new and improved electrical power transformer suitable for use as a distribution transformer in an electrical power distribution system which has unusually low losses, and which naturally accommodates overvoltage conditions. While the invention requires a direct current potential, it is readily achievable from the associated electrical distribution system via solid state rectifier devices. Since the magnetic core of the transformer of the present invention is operated at saturation, the hysteresis losses and the anomalous component of the eddy current losses are both eliminated, resulting in a very low loss power transformer, especially when the magnetic core is constructed of an amorphous alloy.

We claim as our invention:

1. A low loss, single-phase electrical power transformer for transforming voltage magnitudes at power frequencies responsive to the turn ratio of primary and secondary windings, comprising:

a magnetic core in the form of a closed magnetic loop defining a window, and including an outer core surface which surrounds an axially extending opening through the loop, said magnetic core being constructed of magnetic strip material which defines a plurality of concentric, nested lamination turns which encircle the axially extending opening about the complete length of the closed magnetic loop to provide a first low reluctance magnetic path radially about the axially extending opening, and a second low reluctance magnetic path circumferentially about the loop window, with both said first and second magnetic paths being in the plane of said magnetic strip material and devoid of air gaps and butt joints in the directions of these paths, a poloidal winding disposed in said axially extending opening, toroidal primary and secondary windings disposed to link said magnetic core through the loop window, a source of direct current potential connected to energize said poloidal winding with a direct current having a magnitude selected to drive said magnetic core to saturation, said direct current producing a first magnetic flux in the first low reluctance magnetic path which results in a saturation induction vector having an equilibrium position, a source of power frequency alternating potential connected to energize said toroidal primary winding with an alternating current which provides a second magnetic flux in the second low reluctance magnetic path, orthogonal to said first magnetic flux, and a load circuit connected to said toroidal secondary winding, said first and second magnetic fluxes combining vectorially to create a saturation induction vector which oscillates about said equilibrium position, with an angular excursion responsive to the magnitude of the source of alternating potential.

2. The power transformer of claim 1 wherein the magnetic strip material is amorphous alloy.

3. The power transformer of claim 1 wherein adjacent lamination turns are slightly offset, spiralling circumferentially about the magnetic loop.

* * * * *